US006171044B1

(12) United States Patent
De La Torre

(10) Patent No.: US 6,171,044 B1
(45) Date of Patent: Jan. 9, 2001

(54) BINDING MODULE FOR MODULAR SYSTEMS

(75) Inventor: Jaime De La Torre, Zapopa Jaslisco (MX)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/385,622

(22) Filed: Aug. 26, 1999

(51) Int. Cl.[7] ..... B42C 11/00
(52) U.S. Cl. ..... 412/4; 412/14; 412/19
(58) Field of Search ..... 412/4, 6, 13, 14, 412/19, 25

(56) References Cited

U.S. PATENT DOCUMENTS

| | | | | |
|---|---|---|---|---|
| 4,491,448 | * | 1/1985 | Anders et al. | 412/4 |
| 5,413,447 | * | 5/1995 | Rathert | 412/4 |
| 5,417,535 | * | 5/1995 | Andjelic et al. | 412/4 |
| 5,626,452 | * | 5/1997 | Hawkes | 412/4 |
| 5,647,715 | * | 7/1997 | Stolz | 412/4 |
| 5,662,448 | * | 9/1997 | Graushar et al. | 412/4 |
| 5,667,211 | * | 9/1997 | Reist | 412/4 |
| 5,678,813 | * | 10/1997 | Osako et al. | 412/4 |
| 5,868,539 | * | 2/1999 | Rathert | 412/4 |
| 5,871,323 | * | 2/1999 | Clark | 412/4 |
| 5,931,624 | * | 8/1999 | Naruse | 412/4 |

* cited by examiner

*Primary Examiner*—A. L. Wellington
*Assistant Examiner*—Monica S. Carter

(57) ABSTRACT

A binding system in an output system having a plurality of discrete functional modules is disclosed. The output system includes an accumulator module in which sheet material is accumulated in respective jobs to be bound. The binding system includes a cover feed module adapted and constructed to input one of a plurality of different covers into the output system. The binding system further includes a binding module connected to the cover feed module and to the accumulator module. The binding module is adapted to receive a cover from the cover feed module and a job to be bound from the accumulator module, and to place the job to be bound inside the received cover in a desired registration, and to bind the materials within the cover. The cover feed module can include a cover selection mechanism with a measuring arrangement to determine at least one size parameter of the job to be bound. A cover selection arrangement can be provided for selecting a cover corresponding to the measured size parameter from one of the plurality of different covers. The binding system can also include a transport mechanism adapted and constructed to move a selected cover from the cover feed module to the binding module. A cover opening mechanism can be provided to open the selected cover a sufficient amount to permit insertion of the job to be bound into the cover. A job insertion mechanism can be included to insert the job to be bound into the opened cover, and a folding mechanism can be applied to fold the cover around the job after the job has been inserted into the opened cover. The binding module can include a sealing apparatus adapted and constructed to seal the job to be bound in the selected cover. The sealing apparatus can be provided as a heating mechanism.

15 Claims, 3 Drawing Sheets

BINDING MODULE FOR MODULAR SYSTEMS

FIELD OF THE INVENTION

The present invention relates to document binding arrangements combined with output systems associated with imaging systems. More specifically, the present invention relates to a binding module for output systems composed of a plurality of modules.

BACKGROUND OF THE INVENTION

Imaging systems such as printers, fax machines, and copiers are virtually omnipresent, and can be found in homes and offices worldwide. The development of such systems has facilitated improvements in communication that have in turn fostered a sea of change in the way people live and work. Telecommuting, paperless offices, and intra-office networks represent but a few examples of the advancements that have been made possible by modern imaging systems.

Imaging systems have become relatively sophisticated in response to consumer demands. It is not uncommon to find imaging systems associated with output systems capable of collating, sorting, and stapling groups of documents. One example of such an output system a 3000-sheet stapler/stacker, available from Hewlett-Packard Company, for high-capacity HP LaserJet printers. The 3000-sheet stapler/stacker, can be combined with the HP LaserJet 8100 printer to conveniently provide reliable, high-volume printing and finishing for professional-looking documents. Using the HP LaserJet 8100 printer, 3,000-sheet stapler/stacker, automatic duplexer and 2,000-sheet input tray together, users can quickly and easily print, staple and sort numerous copies of large documents on demand. Manuals, training packages and other lengthy printed materials that need to be updated frequently can now be created in-house, allowing businesses to save costs associated with outsourcing and inventory storage and control.

The HP 3000-Sheet Stapler/Stacker includes a series of interconnected modules, each of which performs a discrete function. For example, a flipper module places, or "flips ", documents into proper orientation in an accumulator module, which provides a location for finished documents to be gathered together as they are created to produce a complete document set, or "job ". The job can then be transported to a subsequent module via a transport device such as a conventional elevator mechanism.

Various systems for binding groups of finished documents have arisen in parallel to the advancements in image production. Such systems enable in-house personnel to produce bound sets of materials from documents output from imaging systems. A variety of binding types are available, including spiral binding, flexible spine binding, and thermal binding.

In thermal binding processes, materials are typically placed within a cover, with a thermoplastic spline inserted along an edge of the materials. The binder applies heat, or a combination of heat and pressure, to fuse the spline with the materials, thus forming a bound set.

Unfortunately, imaging systems and binding systems have generally developed separately from one another. Consequently, jobs must be first completed on the imaging system, then introduced manually for processing in the binding system. Usually, jobs must be bound one-at-a-time, requiring a high degree of manual handling.

It can thus be seen that the need exists for a combined imaging/binding arrangement that can be easily integrated into existing systems.

SUMMARY OF THE INVENTION

These and other objects are achieved by providing a binding system in an output system having a plurality of discrete functional modules. The output system includes an accumulator module in which sheet material is accumulated in respective jobs to be bound. The binding system includes a cover feed module adapted and constructed to input one of a plurality of different covers into the output system. The binding system further includes a binding module connected to the cover feed module and to the accumulator module. The binding module is adapted to receive a cover from the cover feed module and a job to be bound from the accumulator module. The binding module is also adapted to place the job to be bound inside the received cover in a desired registration, and to bind the materials within the cover.

The cover feed module can include a cover selection mechanism. In an embodiment, the cover selection mechanism includes a measuring arrangement to determine at least one size parameter of the job to be bound. A cover selection arrangement can be provided for selecting a cover corresponding to the measured size parameter from one of the plurality of different covers.

The binding system can also include a transport mechanism adapted and constructed to move a selected cover from the cover feed module to the binding module.

A cover opening mechanism can be provided to open the selected cover a sufficient amount to permit insertion of the job to be bound into the cover. A job insertion mechanism can be included to insert the job to be bound into the opened cover, and a folding mechanism can be applied to fold the cover around the job after the job has been inserted into the opened cover.

A registration mechanism can be provided to place the job into a predetermined registration for binding after the job has been folded in the cover. The registration mechanism can be provided as a pushing mechanism.

The binding module can include a sealing apparatus adapted and constructed to seal the job to be bound in the selected cover. The sealing apparatus can be provided as a heating mechanism.

An outfeed mechanism can be included to move a bound job from the binding module to an outfeed station. The outfeed mechanism can be provided as an elevator mechanism.

A method of binding jobs into covers is also set forth. The method is described in the context of an output system having a plurality of discrete functional modules including an accumulator module in which sheet material is accumulated in respective jobs to be bound. In a first step, a cover feed module adapted and constructed to input one of a plurality of different covers into the output system is provided. Also provided is a binding module connected to the cover feed module and to the accumulator module. The accumulator module is caused to input a job to be bound into the binding module. Next, the cover feed module is used to input a cover into the binding module. The binding module is then used to place the job to be bound inside the received cover in a desired registration. Finally, the binding module is employed to bind the materials within the cover.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
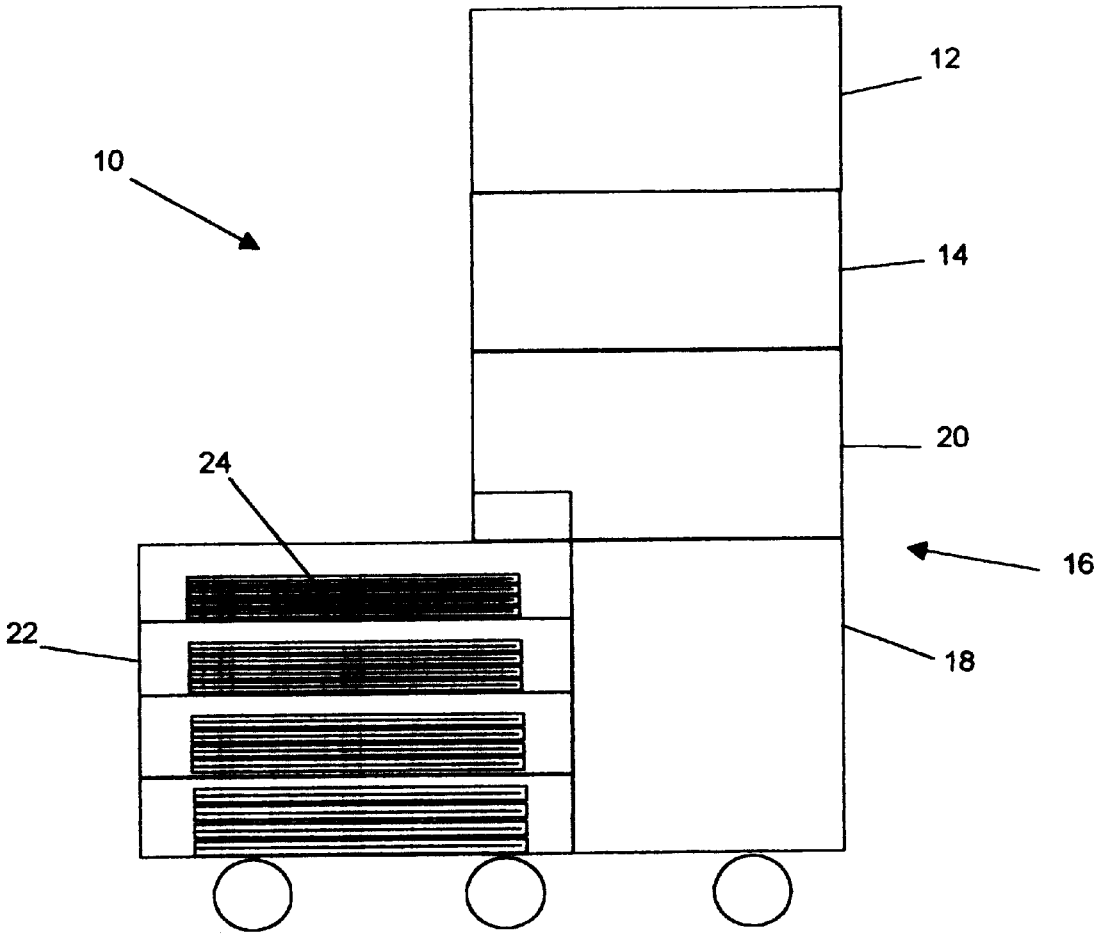
FIG. 1 is a schematic illustration of a modular output system in accordance with the principles of the present invention.

An output system 10 in accordance with the principles of the present invention is shown in FIG. 1. The output system 10 can be connected to an imaging system (not shown), for example, a printer, copier, or fax machine. A flipper module 12 and an accumulator module 14 are shown as being part of the output system 10, which can include other modules not directly related to the present invention. As is known in the art, the accumulator module 14 is used to accumulate documents produced by the output system 10 in groups or "jobs ", which are to be bound. The output system 10 also includes a binding system 16. The binding system 16 includes a cover feed module 18 and a binding module 20.

Figure 2:
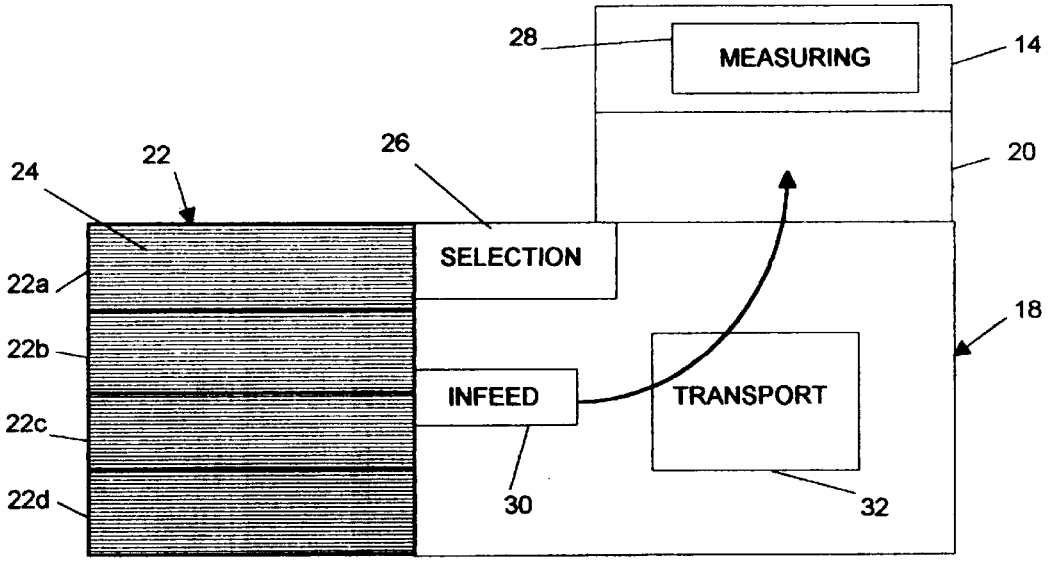
FIG. 2 is a schematic illustration of a cover feed module.

As shown in FIG. 2, the cover feed module 18 includes a magazine 22 adapted to hold a plurality of covers 24. The magazine 22 includes four sections 22*a,* 22*b,* 22*c,* and 22*d,* each of which holds a different size cover. The cover feed module 18 includes a cover selection mechanism 26. The cover selection mechanism 26 includes a measuring arrangement 28 (located in the accumulator module 14) which measures a size parameter (e.g., stack height, length, or width) of the job to be bound. The cover selection mechanism 26 then selects the cover corresponding to the measured size parameter of the job, and actuates an infeed mechanism 30 to bring the cover into the cover feed module 18. A transport mechanism 32 is then employed to convey the selected cover into the binding module 20. The transport mechanism 32 is also used to open the selected cover, thus providing the cover C to the binding module 20 already open a sufficient amount to permit insertion of the job J into the cover C. In a preferred embodiment, the infeed mechanism 30 and transport mechanism 32 are combined in a unitary picking/handling device, as will be appreciated by those of skill in the art.

Figure 3:
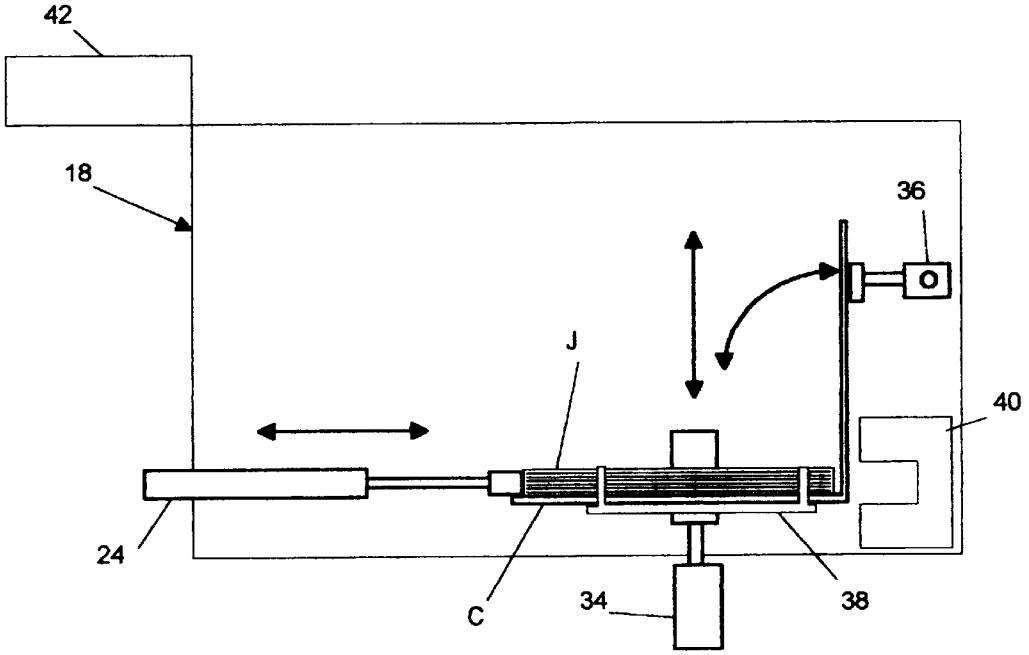
FIG. 3 is a schematic illustration of a binding module.

As shown in FIG. 3, the binding module 20 is adapted to receive a cover C from the cover feed module 18, and a job J to be bound from the accumulator module. The binding module 20 includes an elevator mechanism 34. The elevator mechanism 34 can be used as a job insertion mechanism to insert the job J into the cover C. A folding mechanism 36 can be used to fold the cover C around the job J after the job J has been inserted into the opened cover C.

A pusher assembly 38 acts as a registration mechanism to place the job J into a predetermined registration for binding after the job J has been folded in the cover C.

The binding module 20 includes a sealing apparatus 40 adapted and constructed to seal the job J in the selected cover C. The sealing apparatus 40 is illustrated as a heat-binding mechanism. It is contemplated that the sealing apparatus can be provided as any suitable binding mechanism, such as a combination heat/pressure mechanism or spiral binder.

The elevator mechanism 34 can also be used as an outfeed mechanism to move a bound job from the binding module 20 to an outfeed station 42.

Figure 4:
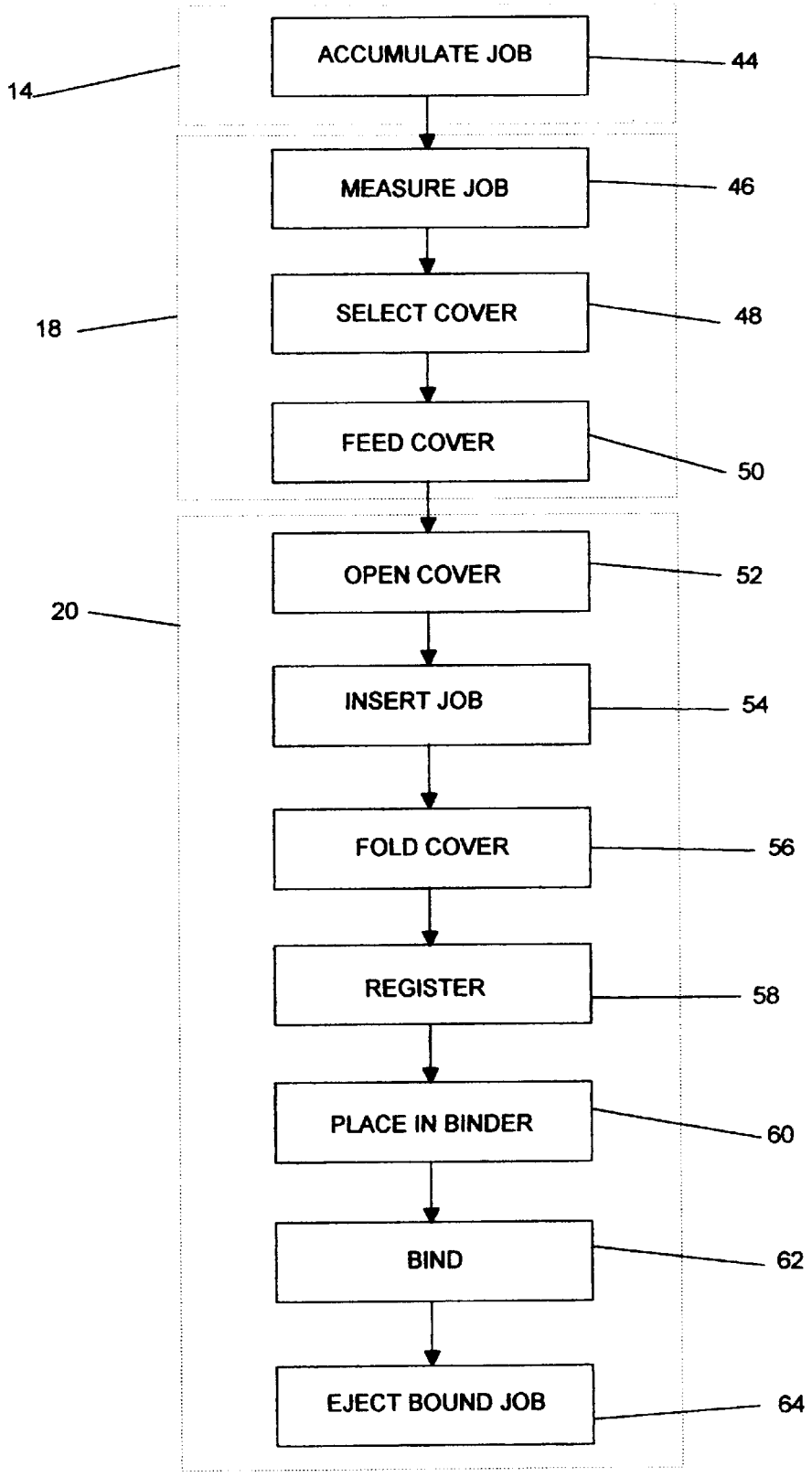
FIG. 4 is a flow chart illustrating the operation of a modular output system in accordance with the principles of the present invention.

Operation of the output system 10 is described with reference to FIG. 4. Once the job is accumulated at point 44, the system 10 measures the thickness of the job J at point 46. Next, a cover is selected from one of the trays of the magazine at point 48, and then fed into the binding module 20 at point 50.

The cover is then opened to a suitable angle, e.g., 90° , at point 52, to receive the job J. The job is then moved down using the elevator and put into the cover C at point 54. The cover C is then folded around the job J at point 56, and registered with the sealing mechanism at point 58. The job J and cover C are then placed inside the sealing mechanism at point 60, which is then actuated to at point 62 to bind the job J in the cover C. Once the binding process is complete, the bound job is sent to an eject platform at point 64.

Although the present invention has been described with reference to specific embodiments, those of skill in the art will recognize that changes may be made thereto without departing from the scope and spirit of the invention as defined by the appended claims.

What is claimed is:

1. In an output system having a plurality of discrete functional modules including an accumulator module in which sheet material is accumulated in respective jobs to be bound, a binding system comprising the following:

a cover feed module adapted and constructed to input one of a plurality of different covers into the output system, the cover feed module comprising a cover selection mechanism including a measuring means to determine at least one size parameter of the job to be bound, and a cover selection means for selecting a cover corresponding to the measured size parameter from one of the plurality of different covers; and a binding module connected to the cover feed module and to the accumulator module, the binding module being adapted to receive a cover from the cover feed module and a job to be bound from the accumulator module, place the job to be bound inside the received cover in a desired registration, and bind the materials within the cover.

2. A binding system in accordance with claim 1, further comprising a transport mechanism adapted and constructed to move a selected cover from the cover feed module to the binding module.

3. A binding system in accordance with claim 1, wherein the binding module comprises a cover opening mechanism adapted and constructed to open the selected cover a sufficient amount to permit insertion of the job to be bound into the cover.

4. A binding system in accordance with claim 3, wherein the binding module comprises a job insertion mechanism adapted and constructed to insert the job to be bound into the opened cover.

5. A binding system in accordance with claim 4, wherein the binding module comprises a folding mechanism adapted and constructed to fold the cover around the job after the job has been inserted into the opened cover.

6. A binding system in accordance with claim 5, wherein the binding module comprises a registration mechanism adapted and constructed to place the job, after the job has been folded in the cover, into a predetermined registration for binding.

7. In an output system having a plurality of discrete functional modules including an accumulator module in which sheet material is accumulated in respective jobs to be bound, a binding system comprising the following:

a cover feed module adapted and constructed to input one of a plurality of different covers into the output system; and a binding module connected to the cover feed module and to the accumulator module, the binding module being adapted to receive a cover from the cover feed module and a job to be bound from the accumulator module, place the job to be bound inside the received cover in a desired registration, and bind the materials within the cover, the binding module including a pushing mechanism adapted and constructed to place the job, after the job has been folded in the cover, into a predetermined registration for binding.

8. In an output system having a plurality of discrete functional modules including an accumulator module in which sheet material is accumulated in respective jobs to be bound, a binding system comprising the following:

a cover feed module adapted and constructed to input one of a plurality of different covers into the output system; and a binding module connected to the cover feed module and to the accumulator module, the binding module being adapted to receive a cover from the cover feed module and a job to be bound from the accumulator module, place the job to be bound inside the received cover in a desired registration, and bind the materials within the cover, the binding module further including a heat-sealing apparatus adapted and constructed to seal the job to be bound in the selected cover.

9. In an output system having a plurality of discrete functional modules including an accumulator module in which sheet material is accumulated in respective jobs to be bound, a binding system comprising the following:

a cover feed module adapted and constructed to input one of a plurality of different covers into the output system; and a binding module connected to the cover feed module and to the accumulator module, the binding module being adapted to receive a cover from the cover feed module and a job to be bound from the accumulator module, place the job to be bound inside the received cover in a desired registration, and bind the materials within the cover; and an outfeed elevator mechanism adapted and constructed to move a bound lob from the binding module to an outfeed station.

10. In an output system having a plurality of discrete functional modules including an accumulator module in which sheet material is accumulated in respective jobs to be bound, a method of binding jobs into covers, the method comprising the following steps:

providing a cove r feed module adapted and constructed to input one of a plurality of different covers into the output system;

providing a binding module connected to the cover feed module and to the accumulator module;

causing the accumulator module to input a job to be bound into the binding module;

causing the cover feed module to input a cover into the binding module;

causing the binding module to place the job to be bound inside the received cover in a desired registration; and causing the binding module to bind the materials within the cover wherein the step of causing the cover feed module to input a cover into the binding module comprises measuring the job to be bound to determine at least one size parameter of the job to be bound; and selecting a cover corresponding to the measured size parameter from one of the plurality of different covers.

11. A method in accordance with claim 10, wherein the step of causing the binding module to place the job to be bound inside the received cover in a desired registration further comprises opening the selected cover a sufficient amount to permit insertion of the job to be bound into the cover.

12. A method in accordance with claim 11, wherein the step of causing the binding module to place the job to be bound inside the received cover in a desired registration further comprises inserting the job to be bound into the opened cover using a pusher mechanism.

13. A method in accordance with claim 12, wherein the step of causing the binding module to place the job to be bound inside the received cover in a desired registration further comprises folding the cover around the job after the job has been inserted into the opened cover.

14. A method in accordance with claim 13, wherein the step of causing the binding module to bind the materials within the cover further comprises heat-sealing seal the job to be bound in the selected cover.

15. A method in accordance with claim 13, further comprising the step of moving the bound job from the binding module to an outfeed station via an elevator mechanism.

* * * * *